US011083274B2

(12) United States Patent
Kim

(10) Patent No.: US 11,083,274 B2
(45) Date of Patent: Aug. 10, 2021

(54) COSMETIC CONTAINER

(71) Applicant: SAMHWA CO., LTD., Uiwang-si (KR)

(72) Inventor: Chang Gon Kim, Hwaseong-si (KR)

(73) Assignee: SAMHWA CO., LTD., Uiwang-si (KR)

( * ) Notice: Subject to any disclaimer, the term of this patent is extended or adjusted under 35 U.S.C. 154(b) by 216 days.

(21) Appl. No.: 16/475,530

(22) PCT Filed: Dec. 28, 2017

(86) PCT No.: PCT/KR2017/015616
§ 371 (c)(1),
(2) Date: Jul. 2, 2019

(87) PCT Pub. No.: WO2018/128327
PCT Pub. Date: Jul. 12, 2018

(65) Prior Publication Data

US 2019/0365075 A1 Dec. 5, 2019

(30) Foreign Application Priority Data

Jan. 5, 2017 (KR) ..... 10-2017-0001827

(51) Int. Cl.
*A45D 33/24* (2006.01)
*A45D 33/00* (2006.01)
(Continued)

(52) U.S. Cl.
CPC ..... *A45D 33/24* (2013.01); *B65D 51/32* (2013.01); *A45D 34/042* (2013.01);
(Continued)

(58) Field of Classification Search
CPC .. A45D 33/24; A45D 2033/001; A45D 34/04; A45D 34/042; A45D 34/045;
(Continued)

(56) References Cited

U.S. PATENT DOCUMENTS 6,945,723 B1 * 9/2005 Gueret ..... A45D 33/02 401/122
7,455,468 B2 * 11/2008 Gueret ..... A45D 34/047 401/122
2012/0132222 A1 * 5/2012 Gueret ..... A45D 34/046 132/200

FOREIGN PATENT DOCUMENTS

KR 20-0217591 Y1 3/2001
KR 20-0362322 Y1 9/2004
(Continued)

*Primary Examiner* — David J Walczak
(74) *Attorney, Agent, or Firm* — Novick, Kim & Lee, PLLC; Jae Youn Kim

(57) ABSTRACT

A cosmetic vessel includes a vessel body for accommodating cosmetic contents; a brush rod guide member of a cylindrical member, the upper and lower parts of which are opened, which is provided with a flange protrusion laid on the opening portion of the vessel body at a center, an upper cylindrical tube formed on the upper portion of the flange protrusion, and a lower cylindrical tube formed at a lower portion of the flange protrusion, an inner diameter of which is narrowed gradually; and a shoulder member of a cylindrical member, the upper and lower parts of which are opened and the upper and lower sides thereof are stepped with respect to a middle portion thereof.

5 Claims, 5 Drawing Sheets

(51) Int. Cl.
*A45D 34/04* (2006.01)
*A45D 40/26* (2006.01)
*B65D 51/32* (2006.01)

(52) U.S. Cl.
CPC ..... *A45D 34/045* (2013.01); *A45D 34/046* (2013.01); *A45D 40/262* (2013.01); *A45D 40/265* (2013.01); *A45D 40/267* (2013.01); *A45D 2033/001* (2013.01)

(58) Field of Classification Search
CPC .... A45D 34/046; A45D 34/047; A45D 40/26; A45D 40/262; A45D 40/265; A45D 20/267; A45D 40/269; B65D 51/32
USPC ..... 401/126, 127, 129, 130
See application file for complete search history.

(56) References Cited

FOREIGN PATENT DOCUMENTS

| | | | |
|---|---|---|---|
| KR | 10-2006-0110227 | A | 10/2006 |
| KR | 10-0933336 | B1 | 12/2009 |
| KR | 10-2016-0136050 | A | 11/2016 |
| KR | 10-1810811 | B1 | 12/2017 |
| WO | 2010-117135 | A2 | 10/2010 |

* cited by examiner

COSMETIC CONTAINER

TECHNICAL FIELD

The present invention relates to a cosmetic vessel, and more particularly, to a cosmetic vessel which allows cosmetic contents to stain on the brush of a brush rod by shaking a vessel body thereof, so that it can be conveniently used.

BACKGROUND ART

In general, pearl powder is one of tint cosmetics, which is a mixture of intensely shiny hologram pearl and crystal pearl ingredients which add gorgeousness to the powder.

Pearl powder is a product for giving a point to skin with soft pearl, and when it is applied on the skin, its color expresses sexy and gorgeous, and thus it is widely used.

Pearl powder can be used as an eye shadow by using the hands or brushes of the user who is applying makeup, or it can also express a unique feel of the pearl by mixing it with various products such as makeup bases, powders, blushers and lip glosses.

The general structure of the pearl powder vessel used as described above has been composed of a vessel body having a hollow-shaped accommodation space for accommodating the pearl powder and an attachable/detachable lid at the upper part of the vessel body. The pearl powder contained in the vessel body described above is usually stained on the tip of a finger or a cosmetic brush, and then is applied on the skin of eyelids, cheeks, and the like for applying makeup.

When the pearl powder is directly applied on the finger as described above, since too much pearl powder is stained on the tip of the finger and thus is wasted, it could not achieve a clean makeup.

A powder vessel to solve the above problems was registered under Utility Model No. 362322.

The above prior registered utility model relates to a powder case which is provided with a discharge plate having a discharge hole on the upper part of a case body with a common storage space for accommodating the contents, so that the pulp powder can be discharged into the discharge hole formed in the discharge plate. The prior registered utility model has solved the problem of a conventional powder vessel, but it is disadvantageous in that since it has a structure in which a lot of empty space is generated in the vessel body when the discharge plate is provided on the vessel body, it is necessary to increase the volume of the powder vessel to prove a product (powder vessel) with a large amount of pearl powder.

DISCLOSURE

Technical Problem

The present invention is invented to meet the needs of the above conventional technology, and it is an object of the present invention to provide a cosmetic vessel which allows cosmetic contents to stain on the brush of a brush rod by shaking a vessel body thereof so that it can be conveniently used.

Technical Solution

The cosmetic vessel according to a first embodiment of the present invention includes: a vessel body 10 for accommodating cosmetic contents; a brush rod guide member 20 of a cylindrical member, the upper and lower parts of which are opened, which is provided with a flange protrusion 21 laid on the opening portion 11 of the vessel body 10 at a center, an upper cylindrical tube 22 formed on the upper part of the flange protrusion 21 and a lower cylindrical tube 23 formed at a lower part of the flange protrusion 21, an inner diameter of which is narrowed gradually; a shoulder member 30 of a cylindrical member, of which the upper and lower parts are opened and the upper and lower sides are stepped with respect to a middle portion thereof, the upper side thereof is located at the outer circumference of the upper cylindrical tube 22 on the brush rod guide member 20, the middle part thereof is laid on the upper surface of the flange protrusion 21, and the lower side thereof is fitted into an outer circumferential lower end protrusion 12 of the upper opening portion 11 of the vessel body 10; an inner lid 40 of a cylindrical member, the upper and lower parts of which are opened, which is screw-coupled to cover an upper side opening of the shoulder member 30; a brush rod 60, an upper end of which is coupled to the inside of the inner lid 40 and a brush 50 is fitted to the lower end thereof; and an outer lid 70 which is coupled to cover the upper and the outer circumference of the inner lid 40.

The cosmetic vessel according to a second embodiment of the present invention includes: a vessel body 10 for accommodating the cosmetic contents; a brush rod guide member 120 of a cylindrical member, the upper part of which is opened, which is provided with a flange protrusion 121 laid on an opening portion 11 of the vessel body 10 at a center, an upper cylindrical tube 122 formed on an upper part of the flange protrusion 121, an inner circumferential close-contact portion 123 protruding to the lower part of the flange protrusion 121 and closely contact an inner circumference of the opening portion 11 of the vessel body 10, and a lower circular portion 124 roundly protruding to the lower part of the flange protrusion 121 to form a plurality of holes 124*a* on a lower surface; a shoulder member 30 of a cylindrical member, of which the upper and lower parts are opened and the upper and lower sides are stepped with respect to a middle portion thereof, the upper side thereof is located at the outer circumference of the upper cylindrical tube 122 in the brush rod guide member 120, the middle part thereof is laid on the upper surface of the flange protrusion 121, and the lower side thereof is fitted into an outer circumferential lower end protrusion 12 of the upper opening portion 11 of the vessel body 10; an inner lid 40 of a cylindrical member, the upper and lower parts of which are opened, which is screw-coupled to cover an upper side opening of the shoulder member 30; a brush rod 60, an upper end of which is coupled to the inside of the inner lid 40 and a brush 50 is fitted to the lower end thereof; and an outer lid 70 which is coupled to cover the upper part and the outer circumference of the inner lid 40.

Advantageous Effects

The cosmetic vessel according to the present invention allows cosmetic contents to stain on the brush of a brush rod by shaking a vessel body thereof, so that it can be conveniently used.

BEST MODE

Figure 1:
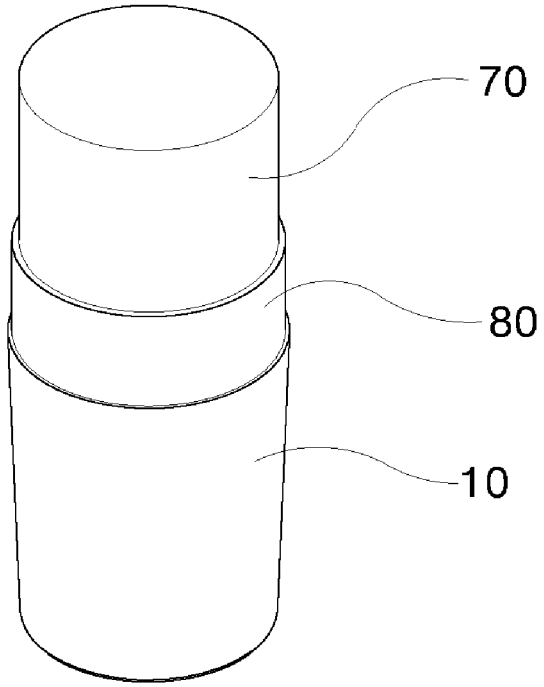
FIG. 1 is an external perspective view showing a cosmetic vessel of the present invention.

Hereinafter, preferred embodiments of the present invention will be described in detail with reference to the accompanying drawings so that these can easily be carried out by those skilled in the art. It should be noted that reference numerals shown in the attached drawings are used throughout the different drawings to denote the same components whenever possible. In addition, in describing the present invention, the detailed description of known functions or known configurations incorporated herein will be omitted if it is deemed that it may unnecessarily obscure the gist of the present invention. Some features shown in the drawings are magnified, reduced, or simplified for ease of explanation, and the drawings and their components are not necessarily illustrated at an appropriate rate. However, those skilled in the art will easily understand these details.

It will be understood that the terms including ordinals such as "first," "second," etc. may be used herein to describe various components, but these components are not limited to the terms. These terms are used only to distinguish one component from another component. For example, the first component may be referred to as a second component without departing from the scope of the claims of the present invention, and similarly, the second component may also be referred to as a first component. The term "and/or" includes any combination of a plurality of related listed items or any of a plurality of related listed items.

In addition, related terms described on the basis of what is shown in the drawings such as "front," "rear," "top," "below," and the like may be replaced with ordinals such as "first," "second," and the like.

The ordinal numbers such as "first," "second," and the like are arbitrarily set in the order described, and thus the order may be arbitrarily changed as necessary.

The terminology used herein is for the purpose of describing particular embodiments only and is not intended to be limiting of the invention. The singular forms comprise plural referents unless the context clearly dictates otherwise. It is to be understood that the terms such as "comprise" or "have" as described in the present specification, are intended to designate the presence of stated features, numbers, steps, operations, components, parts or combinations thereof, but not to preclude the possibility of the presence or addition of one or more other features, numbers, steps, operations, components, parts, or combinations thereof.

Unless otherwise defined, all terms including technical and scientific terms used herein have the same meaning as commonly understood by those skilled in the art to which the present invention pertains. The terms defined in commonly used dictionaries should be interpreted as having a meaning that is consistent with their meaning in the context of the relevant arts, and will not be interpreted in an idealized or overly formal meaning unless expressly so defined herein.

Hereinafter, preferred embodiments of the present invention will be described in detail with reference to the accompanying drawings. In addition, in describing the present invention, the detailed description of known configurations or functions incorporated herein will be omitted if it is deemed that it may unnecessarily obscure the gist of the present invention.

First Embodiment

Figure 2:
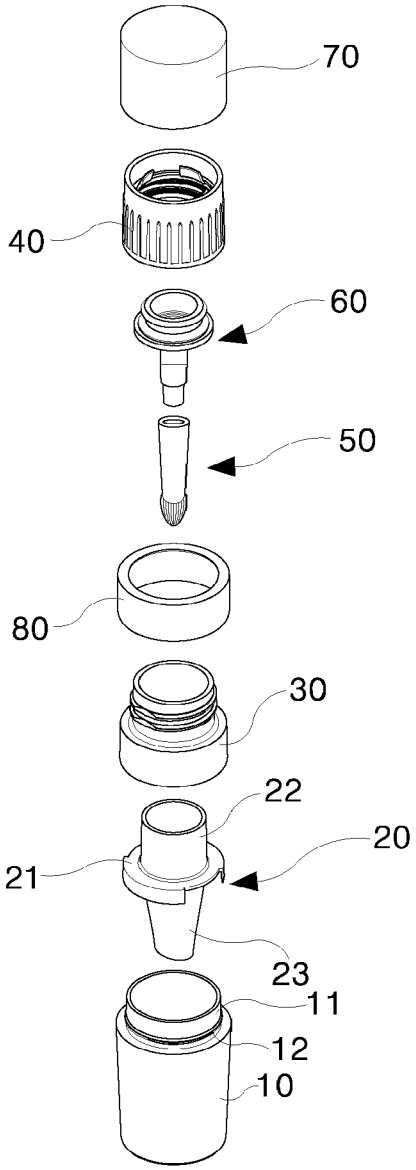
FIG. 2 is an exploded perspective view showing a cosmetic vessel according to a first embodiment of the present invention.
Figure 3:
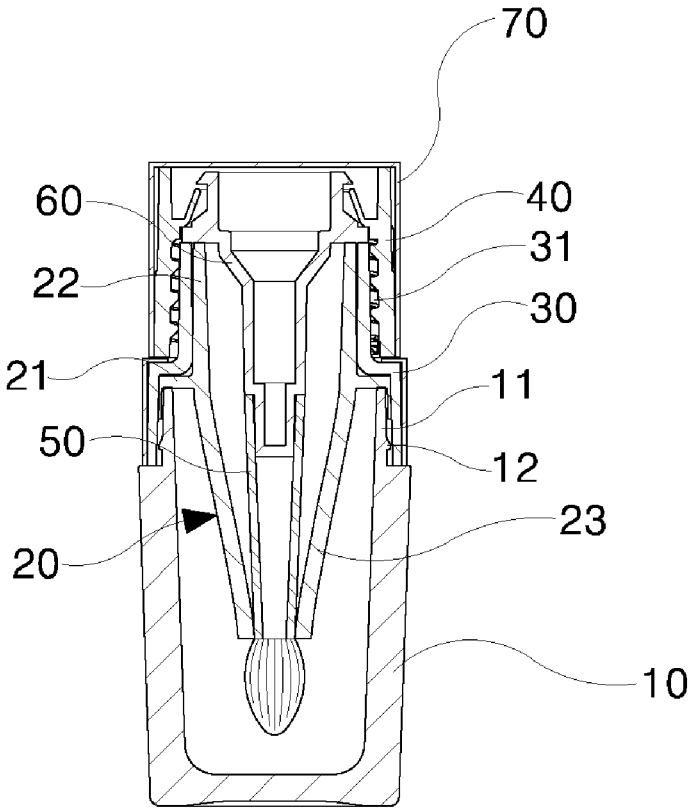
FIG. 3 is an assembled sectional view showing a cosmetic vessel according to the first embodiment of the present invention.

FIG. 1 is an external perspective view showing a cosmetic vessel of the present invention, FIG. 2 is an exploded perspective view showing a cosmetic vessel according to a first embodiment of the present invention, and FIG. 3 is an assembled sectional view showing a cosmetic vessel according to the first embodiment of the present invention.

As shown in FIGS. 1 to 3, the cosmetic vessel according to a first embodiment of the present invention includes: a vessel body 10 for accommodating cosmetic contents; a brush rod guide member 20 of a cylindrical member, the upper and lower parts of which are opened, which is provided with a flange protrusion 21 laid on the opening portion 11 of the vessel body 10 at a center, an upper cylindrical tube 22 formed on the upper part of the flange protrusion 21, a lower cylindrical tube 23 formed at a lower portion of the flange protrusion 21, an inner diameter of which is narrowed gradually; a shoulder member 30 of a cylindrical member, of which the upper and lower parts are opened and the upper and lower sides are stepped with respect to a middle portion thereof, the upper side thereof is located at the outer circumference of the upper cylindrical tube 22 in the brush rod guide member 20, the middle part thereof is laid on the upper surface of the flange protrusion 21, and the lower side thereof is fitted into an outer circumferential lower end protrusion 12 of the upper opening portion 11 of the vessel body 10; an inner lid 40 of a cylindrical member, the upper and lower parts are opened, which is screw-coupled to cover an upper side opening of the shoulder member 30; a brush rod 60, an upper end of which is coupled to the inside of the inner lid 40 and a brush 50 is fitted to the upper end thereof; an outer lid 70 which is coupled to cover the upper part and the outer circumference of the inner lid 40; and a shoulder deco member 80 of a cylindrical member, the upper and lower parts of which are opened, which covers a middle jaw and a lower side of the outer circumference of the lower side of the shoulder member 30 to make an outer appearance beautiful.

The lower cylindrical tube 23 of the brush rod guide member 20 has a shape of an inner diameter which is narrowed gradually toward the lower part thereof.

Next, the function and effect of the cosmetic vessel according to the first embodiment of the present invention will be described.

First, the assembly process of the cosmetic vessel of the present invention will be described. The lower cylindrical tube 23 having a tapered outer diameter is directed to the lower part to be inserted into the upper opening portion 11 of the vessel body 10 containing cosmetic contents so that the flange protrusion 21 is safely seated on an upper surface of the upper opening portion 11. Then, when the shoulder member 30 is pushed into the upper opening portion 11, it is coupled to the outer circumferential lower end protrusion 12 of the opening portion 11. In addition, the shoulder deco member 80 is coupled to make the outer appearance of the shoulder member 30 beautiful.

A brush rod 60 is coupled to an inner lid 40, and a brush 50 is coupled to a lower end of the brush rod 60. In this way, an outer lid 70 is assembled to an outer side of the inner lid 40 to which the brush rod 60 is assembled, thereby completing the assembly of a lid body.

When the brush rod 60 assembled as stated above is inserted into an upper part of the brush rod guide member 20, the brush 50 is positioned at a lower end of the tapered lower cylindrical tube 23, and the inner lid 40 is screwed into the upper side of the shoulder member 30 to complete the assembly.

When shaking the vessel to use the cosmetic vessel which has been completely assembled as stated above, the cosmetic contents in the vessel body 10 are stained on the brush 50 at a lower end of the tapered lower cylindrical tube 23, and the tapered lower cylindrical tube 23 removes the cosmetic contents which are excessively stained on the brush 50 when the outer lid 70 is opened to take out the brush 50.

As described above, the cosmetic vessel is shaken and used, and the makeup may be conveniently applied by removing the cosmetic contents.

Second Embodiment

Figure 4:
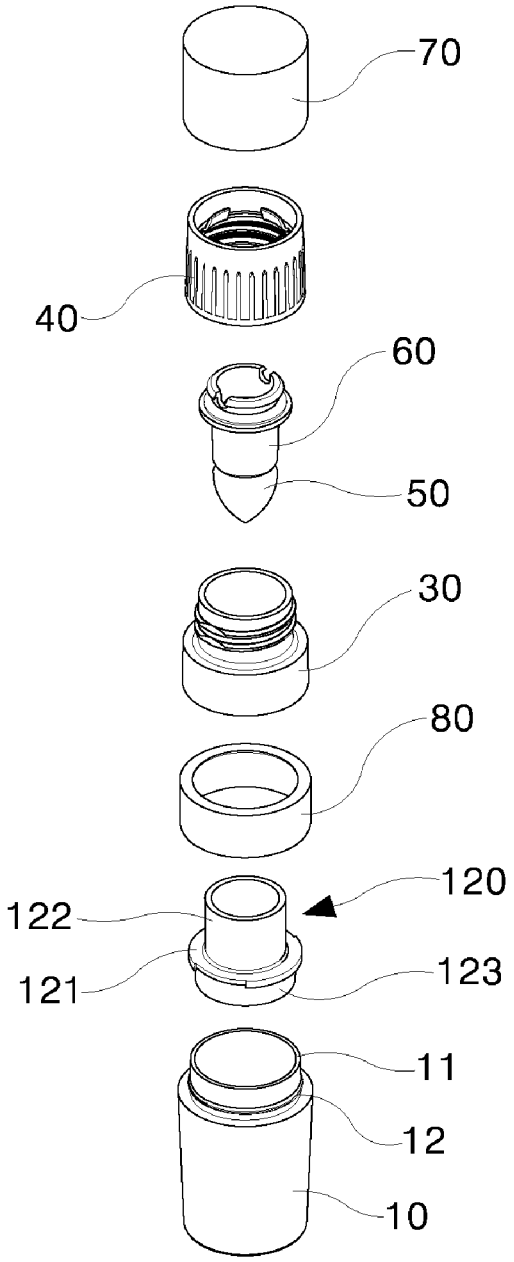
FIG. 4 is an exploded view showing the state before the operation of the cosmetic vessel according to a second embodiment of the present invention is operated.
Figure 5:
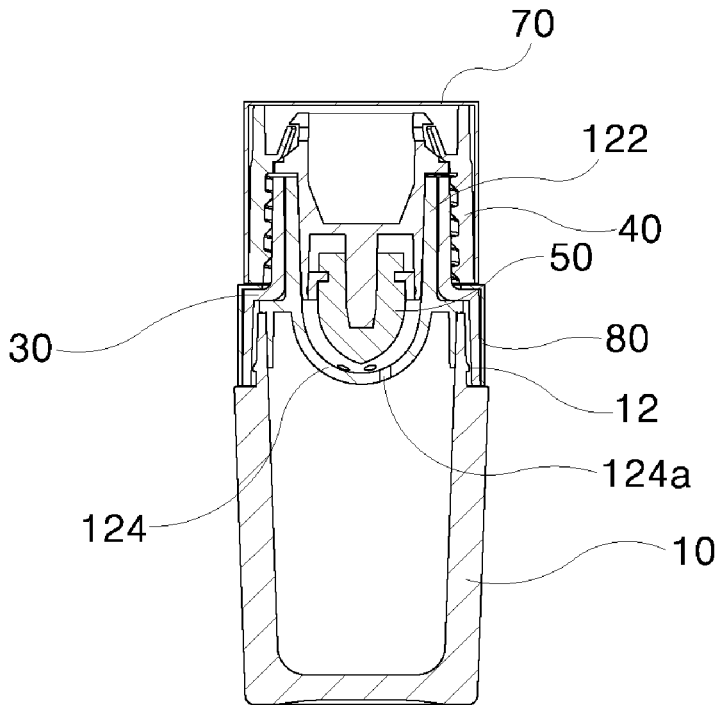
FIG. 5 is an assembled sectional view showing the state after the operation of the cosmetic vessel according to the second embodiment of the present invention is operated.

FIG. 4 is an assembled sectional view showing the cosmetic vessel according to a second embodiment of the present invention, and FIG. 5 is an assembled sectional view showing the cosmetic vessel according to a second embodiment of the present invention.

As shown in FIGS. 4 and 5, the cosmetic vessel according to the second embodiment of the present invention includes: a vessel body 10 for accommodating the cosmetic contents; a brush rod guide member 120 of a cylindrical member, the upper part of which is opened, which is provided with a flange protrusion 121 laid on an opening portion 11 of the vessel body 10 at a center, an upper cylindrical tube 122 formed on an upper part of the flange protrusion 121, an inner circumferential close-contact portion 123 protruding to the lower part of the flange protrusion 121 and closely contact an inner circumference of the opening portion 11 of the vessel body 10, and a lower circular portion 124 roundly protruding to the lower part of the flange protrusion 121 to form a plurality of holes 124*a* on a lower surface; a shoulder member 30 of a cylindrical member, of which the upper and lower parts are opened and the upper and lower sides are stepped with respect to a middle portion thereof, the upper side thereof is located at the outer circumference of the upper cylindrical tube 122 in the brush rod guide member 120, the middle part thereof is laid on the upper surface of the flange protrusion 121, and the lower side thereof is fitted into an outer circumferential lower end protrusion 12 of the upper opening portion of the vessel body 10; an inner lid 40 of a cylindrical member, the upper and lower portions of which are opened, which is screw-coupled to cover an upper side opening of the shoulder member 30; a brush rod 60, an upper end of which is coupled to the inside of the inner lid 40 and a brush 50 fitted to the upper end thereof; an outer lid 70 which is coupled to cover the upper part and the outer circumference of the inner lid 40; and a shoulder deco member 80 of a cylindrical member, the upper and lower parts of which are opened, which covers a middle jaw and a lower side outer circumference of the shoulder member 30 to make an outer appearance beautiful.

Next, the function and effect of the cosmetic vessel according to the second embodiment of the present invention will be described.

First, the assembly process of the cosmetic vessel of the present invention will be described. The lower cylindrical portion 124 is directed downward and then inserted into the upper opening portion 11 of the vessel body 10 containing cosmetic contents so that the flange protrusion 121 is safely seated on an upper surface of the upper opening portion 11. Thereafter, when the shoulder member 30 is pushed and coupled to the upper opening portion 11, it is coupled to the outer circumferential lower end protrusion 12 of the upper opening portion 11. In addition, the shoulder deco member 80 is coupled to make the outer appearance of the shoulder member 30 beautiful.

A brush rod 60 is coupled to an inner lid 40, and a brush 50 is coupled to a lower end of the brush rod 60. In this way, an outer lid 70 is assembled to an outer side of the inner lid 40, to which the brush rod 60 is assembled, thereby completing the assembly of a lid body.

When the brush rod 60 of the lid body assembled as stated above is inserted through an upper portion of the brush rod guide member 20, the brush 50 is positioned in a lower cylindrical portion 124, and the inner lid 40 is screwed into the upper side of the shoulder portion 30 complete the assembly.

When shaking the vessel to use the cosmetic vessel which has been completely assembled as stated above, the cosmetic contents in the vessel body 10 are stained on the brush 50 through a hole 124*a* of the lower circular portion 124 so as to apply makeup by opening the outer lid 70.

As such, it is possible to conveniently apply makeup by shaking and using the cosmetic vessel.

As described above, while the present invention has been described with respect to the specific embodiments, it will be apparent to those skilled in the art that various changes and modifications may be made without departing from the spirit and scope of the present invention as defined in the claims.

The invention claimed is:

1. A cosmetic vessel, comprising:

a vessel body for accommodating cosmetic contents;

a brush rod guide member of a cylindrical member, an upper and lower parts of which are opened, which is provided with a flange protrusion laid on an opening portion of the vessel body at a center, an upper cylindrical tube formed on an upper portion of the flange protrusion, and a lower cylindrical tube formed at a lower portion of the flange protrusion, an inner diameter of which is narrowed gradually;

a shoulder member of a cylindrical member, of which an upper and lower parts are opened and an upper and lower sides are stepped with respect to a middle portion thereof, the upper side thereof is located at an outer circumference of the upper cylindrical tube on the brush rod guide member, a middle part thereof is laid on an upper surface of the flange protrusion, and the lower side thereof is fitted into an outer circumferential lower end protrusion of an upper opening portion of the vessel body;

an inner lid of a cylindrical member, an upper and lower parts of which are opened, which is screw-coupled to cover an upper side opening of the shoulder member;

a brush rod, an upper end of which is coupled to an inside of the inner lid and to a lower end of which a brush is fitted; and an outer lid which is coupled to cover the upper part of the inner lid and an outer circumference of the inner lid.

2. The cosmetic vessel according to claim 1, further comprising a shoulder deco member of a cylindrical member, an upper and lower parts of which are opened, which covers a middle jaw and an outer circumference of the lower side of the shoulder member.

3. The cosmetic vessel according to claim 1, wherein the lower cylindrical tube of the brush rod guide has a shape in which an inner diameter is gradually narrower toward a lower part thereof.

4. A cosmetic vessel, comprising:

a vessel body for accommodating cosmetic contents;

a brush rod guide member of a cylindrical member, an upper and lower parts of which are opened, which is provided with a flange protrusion laid on an opening portion of the vessel body at a center, an upper cylindrical tube formed on an upper part of the flange protrusion, an inner circumferential close-contact portion protruding to a lower part of the flange protrusion and closely contacting an inner circumference of the opening portion of the vessel body , and a lower circular portion roundly protruding to the lower part of the flange protrusion to form a plurality of holes on a lower surface;

a shoulder member of a cylindrical member, of which an upper and lower parts are opened and an upper and lower sides are stepped with respect to a middle portion thereof, the upper side thereof is located at an outer circumference of the upper cylindrical tube in the brush rod guide member, a middle part thereof is laid on an upper surface of the flange protrusion, and the lower side thereof is fitted into an outer circumferential lower end protrusion of an upper opening portion of the vessel body;

an inner lid (40) of a cylindrical member, an upper and lower parts of which are opened, which is screw-coupled to cover an upper side opening of the shoulder member;

a brush rod, an upper end of which is coupled to an inside of the inner lid and to a lower end of which a brush is fitted; and an outer lid which is coupled to cover the upper part of the inner lid and an outer circumference of the inner lid.

5. The cosmetic vessel according to claim 4, further comprising a shoulder deco member of a cylindrical member, an upper and lower parts of which are opened, which covers a middle jaw and an outer circumference of the lower side of the shoulder member.

* * * * *